US005217543A

United States Patent [19]

Inokoshi

[11] Patent Number: 5,217,543

[45] Date of Patent: Jun. 8, 1993

[54] RARE EARTH-IRON MAGNET

[75] Inventor: Yoshio Inokoshi, Tokyo, Japan

[73] Assignee: Seiko Instruments Inc., Japan

[21] Appl. No.: 880,710

[22] Filed: May 8, 1992

[30] Foreign Application Priority Data

May 14, 1991 [JP] Japan ..... 3-109441

[51] Int. Cl.[5] ..... H01F 1/053

[52] U.S. Cl. ..... 148/302; 75/233; 75/234; 75/244

[58] Field of Search ..... 148/302; 420/83, 121; 75/233, 234, 244

[56] References Cited

U.S. PATENT DOCUMENTS

| | | | |
|---|---|---|---|
| 4,588,439 | 5/1986 | Narasimban et al. | 148/302 |
| 4,770,702 | 9/1988 | Ishigaki et al. | 75/244 |
| 4,878,964 | 11/1989 | Mizoguchi et al. | 148/302 |
| 4,935,075 | 6/1990 | Mizoguchi et al. | 148/302 |

FOREIGN PATENT DOCUMENTS

| | | | |
|---|---|---|---|
| 0255939 | 2/1988 | European Pat. Off. | 148/302 |
| 3637521 | 5/1988 | Fed. Rep. of Germany | 148/302 |
| 61-67752 | 4/1986 | Japan | 75/244 |
| 1-169904 | 7/1989 | Japan | 148/302 |
| 2-3210 | 1/1990 | Japan | 148/302 |

*Primary Examiner*—John P. Sheehan

*Attorney, Agent, or Firm*—Bruce L. Adams; Van C. Wilks

[57] ABSTRACT

A rare earth-iron magnet consisting of, by atomic percent, 10 to 16% Nd, 5 to 10% B, 0.1 to 1% V, 0.1 to 1% oxygen and the balance being Fe.

3 Claims, No Drawings

RARE EARTH-IRON MAGNET

BACKGROUND OF THE INVENTION

1. Field of the Invention

This invention relates to the field of rare earth-iron magnets.

Instruments using magnets have been widely used for rotary instruments such as motors and peripheral terminal devices of computers. As a rare earth-iron magnet has the highest maximum energy product of all available magnets on the market, it is easy to upgrade and miniaturize instruments using such magnets.

2. Description of the Prior Art

Before this invention, surface finishing technology such as aluminium-chromating, epoxy electrodeposition painting and nickel electrodeposition plating has been used to coat magnet surfaces because corrosion resistance is improved by coating the surface of the magnets with a protection layer for anti-corrosion of the rare earth-iron magnet.

The magnetic characteristics deteriorate, however, because a surface layer of the magnet is damaged by the prior art surface treatment technology. This problem appears particularly in small-sized magnets having a large specific surface. For example, a small-sized rare earth magnet having a volume of $1\times10^{-3}$ cm$^3$ for a watch is improved in corrosion resistance by aluminium-chromating, but it is inferior by one and one-half times in coercive force and by one third in maximum energy product in comparison with a similar rare earth magnet not having such a surface treatment. Accordingly, such as surface-finished magnet is not suitable for practical use.

SUMMARY OF THE INVENTION

An object of the present invention is therefore to improve the corrosion resistance of small-sized rare earth-ion magnets.

According to the present invention, the magnet material for anti-corrosion can be obtained by preparing compositions consisting of, by atomic percent, 10 to 16% Nd, 5 to 10% B, 0.1 to 1% V, 0.1 to 1% Cr, 0.1 to 1% O and the balance being Fe. Consequently, it became clear that the alloy for magnets is superior in corrosion resistance properties and has about 35 MGOe in maximum energy product and about 10 kOe in coercive force. These are the same characteristics as that of present rare earth-iron magnets.

In the anti-corrosion, sample magnet according to the present invention, the condensed phase of $V_2O_5$ and $Cr_2O_3$ is seen in the crystal grain boundary as the crystal grain of corrosive $Nd_2Fe_{14}B_1$ tetragonal crystal according to the observation by scanning electron microscopy and element analysis technique by characteristic X Rays. It is considered that the condensed phase of $V_2O_5$ and $Cr_2O_3$ in the crystal grain boundary is closely related to the phenomenon of anti-corrosion.

DESCRIPTION OF THE PREFERRED EMBODIMENTS

The present invention will now be explained in detail. As the starting materials, an alloy comprising, by atomic percent, 8 to 20% Nd, 3 to 12% B, 0.05 to 1.5% V, 0.05 to 1.5% Cr, 0.05–1.5% O and the balance being Fe was dissolved by arc dissolution. Next, an ingot of the alloy was ground by a ball mill, producing a powder having a particle size of 3 to 3.5 microns. The powder was put in a metal mold, oriented in a magnetic field of 20 kOe, and molded by a pressure of 2 t/cm$^2$ in a direction perpendicular to the magnetic field to produce an anisotropic green product.

The anisotropic green product was sintered at 1050° to 1130 ° C. for one hour and allowed to cool after annealing at 600 ° C. for one hour to improve the coercive force of the sample magnet.

After being cut into a column, the magnet characteristics of the sample magnet were evaluated by measuring the B-H curve with search coil for horizontal coaxial compensation and reading directly the demagnetization curve on a recorder.

The corrosion resistance was evaluated by measuring the weight change per unit area of the sample magnet placed at 40° C. and 95% humidity for 500 hours.

The weight change of the sample is caused almost entirely by corrosion. The higher the corrosion resistance becomes, the smaller the change in weight.

The results are shown in Table 1 to Table 3.

TABLE 1

| | (Volume of Magnet = $1\times10^{-4}$ cm$^3$) | | |
|---|---|---|---|
| | Magnet Characteristic | | Weight Change Per |
| Sample | BHmax (MGOe) | iHc (KOe) | Unit Area (g/cm$^2$) |
| Product by Prior Art | | | |
| $Nd_{15}B_8$ The Balance Fe (No Treatment) | 35.1 | 11.0 | $3.1\times10^{-1}$ |
| $Nd_{15}B_8$ The Balance Fe + Aluminium Chromating (10 μm) | 10.0 | 5.6 | $4.3\times10^{-3}$ |
| Nd B The Balance Fe + Epoxy Painting (10 μm) | 11.1 | 5.9 | $3.8\times10^{-3}$ |
| $Nd_{15}B_8$ The Balance Fe + Nickel Electrodeposition Plating (5 μm) | 9.9 | 5.2 | $1.5\times10^{-3}$ |
| Product compared with | | | |
| $Nd_8B_8O_1V_1Cr_1$ The Balance Fe | 4.3 | 3.1 | $3.2\times10^{-3}$ |
| $Nd_{20}B_8O_1V_1Cr_1$ The Balance Fe | 27.0 | 13.5 | $3.6\times10^{-3}$ |
| $Nd_{15}B_3O_1V_1Cr_1$ The Balance Fe | 12.4 | 2.1 | $3.5\times10^{-3}$ |

TABLE 2

| | (Volume of Magnet = $1\times10^{-4}$ cm$^3$) | | |
|---|---|---|---|
| | Magnet Characteristic | | Weight Change Per |
| Sample | BHmax (MGOe) | iHc (KOe) | Unit Area (g/cm$^2$) |
| Product compared with | | | |
| $Nd_{15}B_{12}O_1V_1Cr_1$ The Balance Fe | 24.0 | 14.6 | $5.6\times10^{-3}$ |
| $Nd_{15}B_8O_{0.05}V_1Cr_1$ The Balance Fe | 34.0 | 9.6 | $4.6\times10^{-2}$ |
| $Nd_{15}B_8O_{1.5}V_1Cr_1$ The Balance Fe | 9.8 | 3.2 | $9.6\times10^{-4}$ |
| $Nd_{15}B_8O_1V_{0.05}Cr_1$ The Balance Fe | 34.1 | 11.3 | $7.6\times10^{-2}$ |
| $Nd_{15}B_8O_1V_{1.5}Cr_1$ The Balance Fe | 24.9 | 6.5 | $3.1\times10^{-3}$ |
| $Nd_{15}B_8O_1V_1Cr_{0.05}$ The Balance Fe | 24.1 | 11.9 | $2.9\times10^{-2}$ |
| $Nd_{15}B_8O_1V_1Cr_{1.5}$ | 23.2 | 8.8 | $8.7\times10^{-4}$ |

TABLE 2-continued

| Sample | (Volume of Magnet = $1 \times 10^{-4}$ cm$^3$) Magnet Characteristic BHmax (MGOe) | iHc (KOe) | Weight Change Per Unit Area (g/cm$^2$) |
|---|---|---|---|
| The Balance Fe | | | |

TABLE 3

| Sample | (Volume of Magnet = $1 \times 10^{-4}$ cm$^3$) Magnet Characteristic BHmax (MGOe) | iHc (KOe) | Weight Change Per Unit Area (g/cm$^2$) |
|---|---|---|---|
| Product According to the Invention | | | |
| $Nd_{15}B_8O_1V_1Cr_1$ The Balance Fe | 34.5 | 11.0 | $8.9 \times 10^{-4}$ |
| $Nd_{16}B_8O_1V_1Cr_1$ The Balance Fe | 33.0 | 13.2 | $8.8 \times 10^{-4}$ |
| $Nd_{15}B_6O_1V_{0.5}Cr_{0.5}$ The Balance Fe | 36.1 | 9.5 | $9.3 \times 10^{-4}$ |
| $Nd_{15}B_{10}O_{0.5}V_{0.5}Cr_{0.5}$ The Balance Fe | 31.9 | 10.6 | $1.2 \times 10^{-3}$ |
| $Nd_{15}B_8O_{0.5}V_{0.5}Cr_1$ The Balance Fe | 34.5 | 10.8 | $3.1 \times 10^{-3}$ |

According to Table 1, the prior art product without treatment is improved in magnetic characteristics but it is inferior in corrosion resistance because eh weight change per unit area thereof is large. Further the Prior Art product with treatment is improved in corrosion resistance but it is inferior by one third in magnetic characteristics, especially in maximum energy product. Accordingly, the small-sized magnet of the prior art is not suitable for practical use compared with a samarium cobalt magnet.

On the other hand, the magnet of the invention is superior in anti-corrosion property and the magnetic characteristics thereof are the same as the prior art magnet composed of $Nd_{15}B_8$ with the balance Fe.

As mentioned above, the condensed phase of $V_2O_5$ and $Cr_2O_3$ was seen in the crystal grain boundary as the crystal grain of corrosive $Nd_2Fe_{14}B_1$ teragonal crystal is covered in hexa alloy of NdFeBVCrO. In a tetra alloy of NdFeB not having the condensed phase of $V_2O_5$ and $Cr_2O_3$, the magnet becomes irregular in structure after an environmental test, and an oxide consisting mainly of Fe appears on the surface of the magnet. Considering the two facts mentioned above, the existence of $V_2O_5$ and $Cr_2O_3$ protects disintegration and oxygenation occurring due to high temperature and humidity of $Nd_2Fe_{14}B_1$ tetragonal crystal, which is a main component of a magnet and contributes to improvement of the anti-corrosion properties by suppressing appearance of rust.

The composition of Nd is limited for the following reason. If the Nd quantity is under 10%, both the maximum energy product and the coercive force become inferior remarkably. If the Nd quantity is over 16%, the maximum energy product becomes inferior slightly and the anti-corrosion property becomes inferior according to the product compared with in Table 1 and Table 2.

The compositions of B, O, V and Cr are limited too in consideration of opposite characteristics, i.e. magnetic characteristics and anti-corrosion.

As mentioned above, the present invention is most suitable for a small-sized magnet used in a watch and the line and for other uses requiring an excellent anti-corrosion magnet.

What is claimed is:

1. A rare earth-iron magnet consisting of, by atomic percent, 10 to 16% Nd, 5 to 10% B, 0.1 to 1% V, 0.1 to 1% Cr, 0.1 to 1% oxygen and the balance being Fe.

2. A rare earth-iron magnet as claimed in claim 1; wherein the magnet is produced by sintering molded metal powder.

3. A rare earth-iron magnet as claimed in claim 2; wherein the molded metal powder is an anisotropic permanent magnet.

* * * * *